US006742967B1

(12) United States Patent
Chou et al.

(10) Patent No.: US 6,742,967 B1
(45) Date of Patent: Jun. 1, 2004

(54) STRUCTURE FOR FASTENING SOIL NAILS TO REINFORCED SOIL RETAINING WALLS

(76) Inventors: Nelson N. S. Chou, No. 18, Lane 16, Sanmun Rd., Chiunglun Shiang, Hsinchu Hsien (TW); Chia-Cheng Fan, 10F, No. 366, Jengde Rd., Kaohsiung City (TW)

( * ) Notice: Subject to any disclaimer, the term of this patent is extended or adjusted under 35 U.S.C. 154(b) by 0 days.

(21) Appl. No.: 10/289,415

(22) Filed: Nov. 7, 2002

(51) Int. Cl.[7] ..... E02D 29/02

(52) U.S. Cl. ..... 405/262; 405/258.1; 405/284; 405/287

(58) Field of Search ..... 405/258.1, 259.1, 405/262, 244, 172, 284, 285, 287

(56) References Cited

U.S. PATENT DOCUMENTS 3,490,242 A * 1/1970 Schnabel, Jr. ..... 405/262
4,329,089 A * 5/1982 Hilfiker et al. ..... 405/262
4,911,582 A * 3/1990 Peirce et al. ..... 405/262
4,961,673 A * 10/1990 Pagano et al. ..... 405/287
5,395,185 A * 3/1995 Schnabel, Jr. ..... 405/287
6,299,386 B1 * 10/2001 Byrne et al. ..... 405/273
6,565,288 B1 * 5/2003 McCallion ..... 405/259.5

FOREIGN PATENT DOCUMENTS

| | | |
|---|---|---|
| CA | 2271188 | * 11/2000 |
| EP | 540060 | * 5/1993 |
| GB | 2212196 | * 7/1989 |
| GB | 2289078 | * 11/1995 |

* cited by examiner

*Primary Examiner*—Jong-Suk (James) Lee
(74) *Attorney, Agent, or Firm*—Birch, Stewart, Kolasch & Birch, LLP

(57) ABSTRACT

A fastening system is invented for fasten the soil nails (which are used in cut areas) and the reinforced retaining structures (which are used in fill areas). The system is to connect the two and form an integrated body to prevent sliding plane passing through the interface of the two. The fastening system includes coupling elements, struts, flanges, steel pipes, cables, annular sleeve and clamps.

6 Claims, 7 Drawing Sheets

STRUCTURE FOR FASTENING SOIL NAILS TO REINFORCED SOIL RETAINING WALLS

FIELD OF THE INVENTION

The present invention relates to fastening structure for coupling soil nails and reinforced soil retaining wall.

BACKGROUND OF THE INVENTION

In recent years, reinforced soil retaining walls have been extensively used to replace conventional concrete wall for fill work. For cutting areas, soil nailings are developed to reinforce the existing ground for preventing landslides. However, there is a need to combine soil nailing and reinforced soil structure if both cut and fill conditions are encountered at the same time.

SUMMARY OF THE INVENTION

The primary object of the invention is to fulfill aforesaid needs. The invention provides a fastening structure to couple soil nailing and reinforced soil retaining wall for forming an integrated structure.

Another object of the invention is to utilize resistant force of the reinforced retaining wall to increase the stability of the soil nailing on the excavation site and offers a construction method safer than conventional soil nailing construction technique.

Yet another object of the invention is to fasten the soil nailing and the reinforced soil retaining wall to become an integrated body to prevent sliding plane from passing through the interface of the two.

In order to achieve the foregoing objects, the retaining structure of the invention includes soil nailings, a fastening structure and a reinforced retaining wall. The soil nailings are installed and buried into the earth through the wall of the work site, and then the fastening structure is assembled to the soil nailing. Finally, the reinforced retaining wall is fastened to the fastening structure to complete the construction of the invention.

The construction thus combines and integrates the soil nailing and reinforced soil walls to increase the stability of the whole system. After a number of soil nailings have been installed into the slope wall, zinc coated and spot soldered wire meshes are laid with non-woven fabrics and water permeable gravel materials on sloped wall over the soil nailings, then fasten the reinforced retaining wall to the soil nailings.

The following is a detailed description of the invention with the accompanying drawings.

DESCRIPTION OF THE PREFERRED EMBODIMENT

Figure 3:
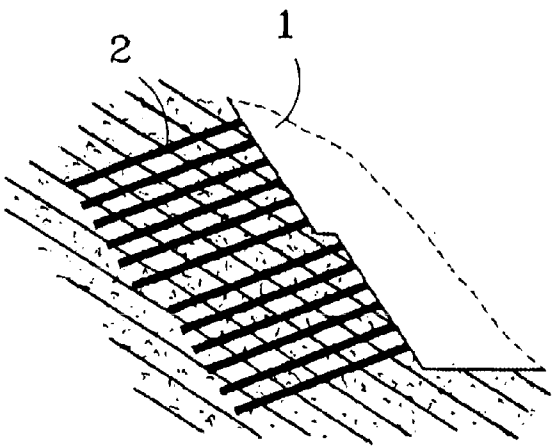
FIG. 3 is a schematic view of the completed set of soil nailings.
Figure 2:
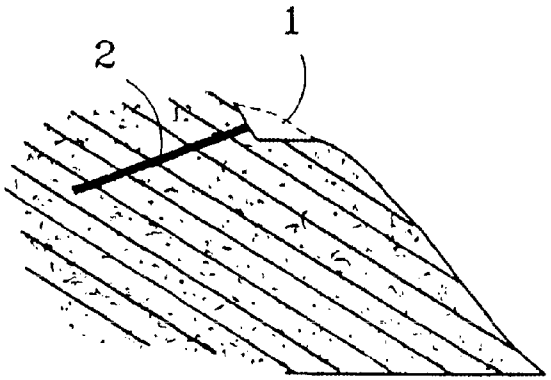
FIG. 2 is a schematic view of first soil nailing installation.
Figure 1:
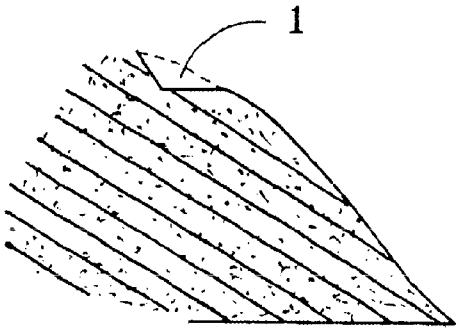
FIG. 1 is a schematic view of excavating a construction site on a slope land.
Figure 4:
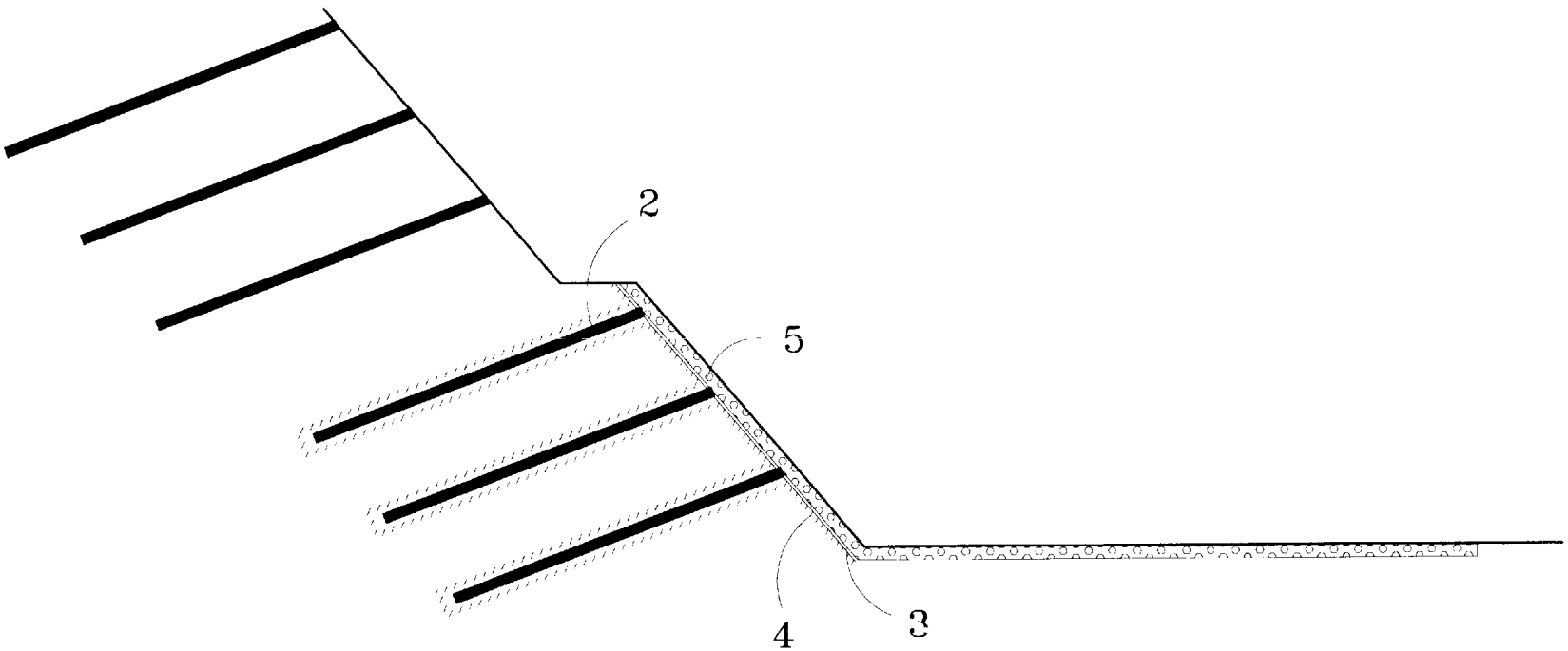
FIG. 4 is a schematic view of zinc coated and spot soldered wire meshes, non-woven fabrics and water permeable gravel materials laid on the excavated area.
Figure 5A:
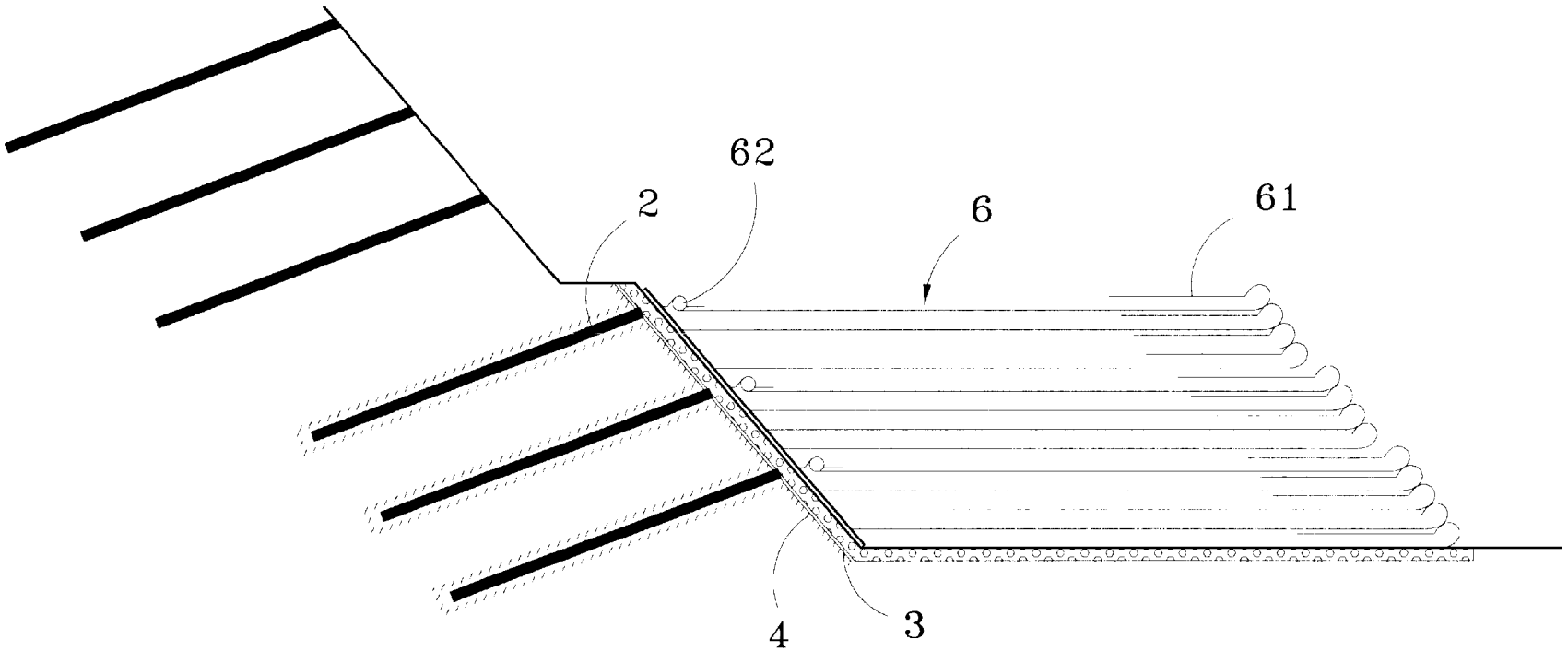
FIG. 5A is a schematic view of fastening the reinforced retaining wall to soil nailing.

Referring to FIGS. 1, 2 and 3 for an embodiment of the invention, prior to the construction and installation of the invention, setup a work site 1 by excavating a slope land. After the work site 1 is ready, install soil nailing 2 into the earth through the wall of the work site 1. After complete installation of the soil nailing 2, lay a zinc-coated and spot-soldered wire meshes 3, non-woven fabrics 4 and water permeable gravel materials 5 on the slope wall over the soil nailing (as shown in FIG. 4) to ensure safety and convenience of the work in the later phases. Then the work for fastening the soil nailing 2 and reinforced retaining wall 6 (as shown in FIG. 5A) may be started.

Figure 5B:
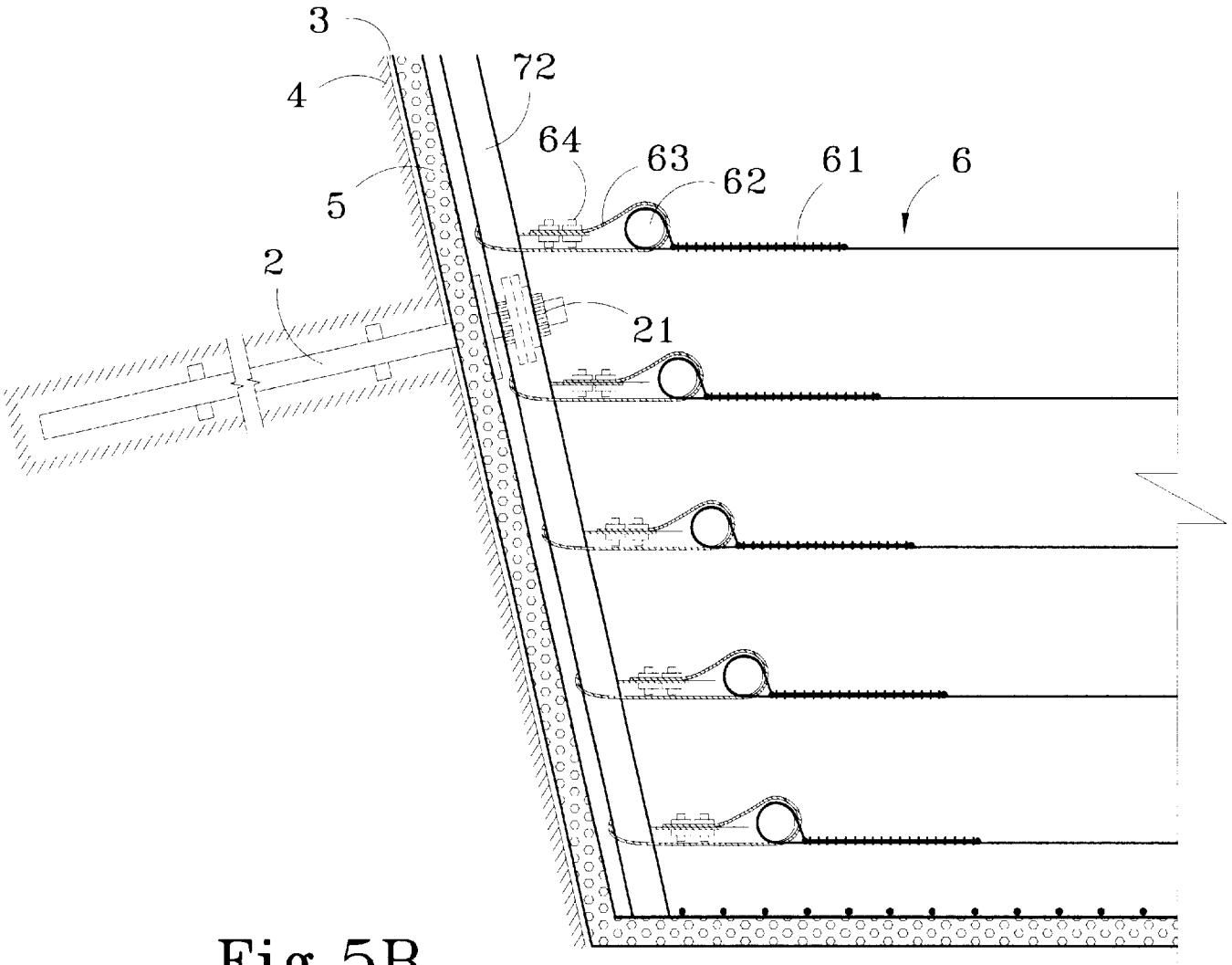
FIG. 5B is an enlarged view of FIG. 5A.
Figure 6:
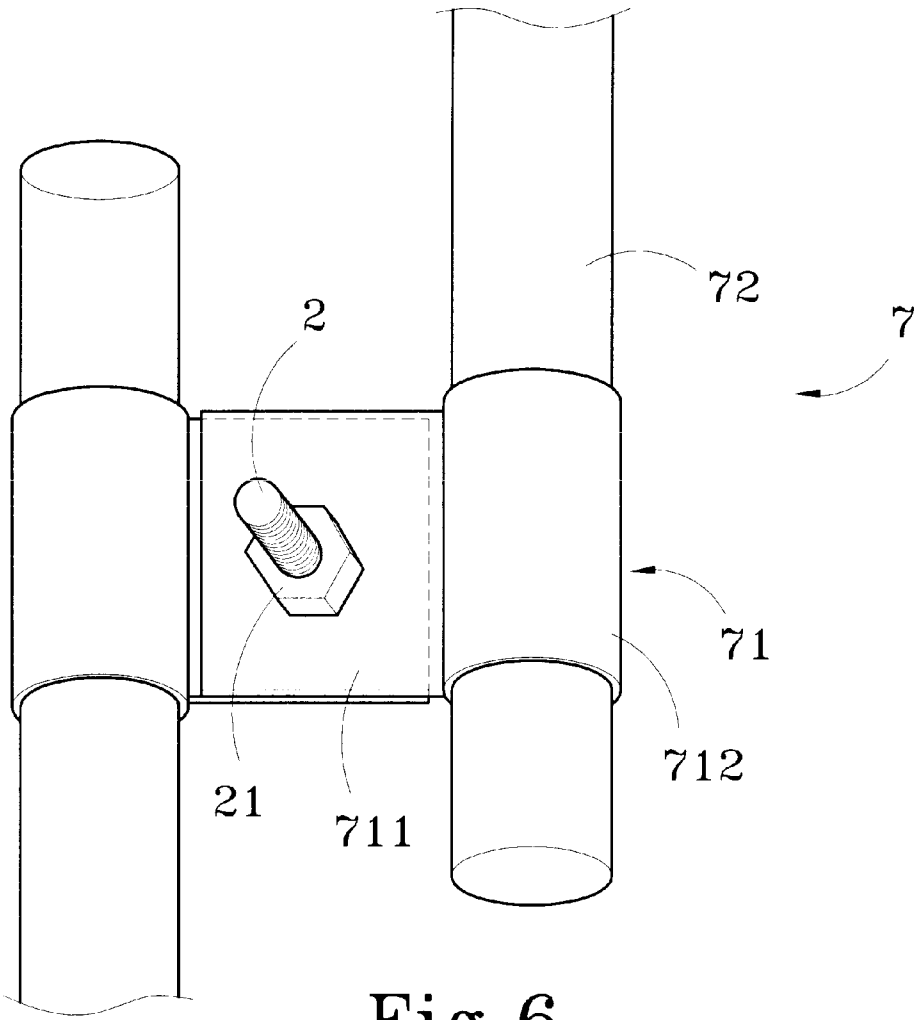
FIG. 6 is a schematic view of the fastening structure of the invention, coupling with a soil nailing.

Referring to FIGS. 5B and 6, to fasten the soil nailing 2 and reinforced retaining wall 6, each soil nailing 2 is engaged with a fastening means 7. The fastening means 7 includes a coupling element 71 and a strut 72 made of solid or hollow steel pipes. The coupling element 71 has an annular sleeve 712 to hold the strut 72 and a flange 711 engaging with the soil nailing 2 through a fasten element 21 made of a screw nut. A series of soil nailing 2 may be linked and fastened by a series of struts 72 (as shown in FIG. 8).

Figure 7:
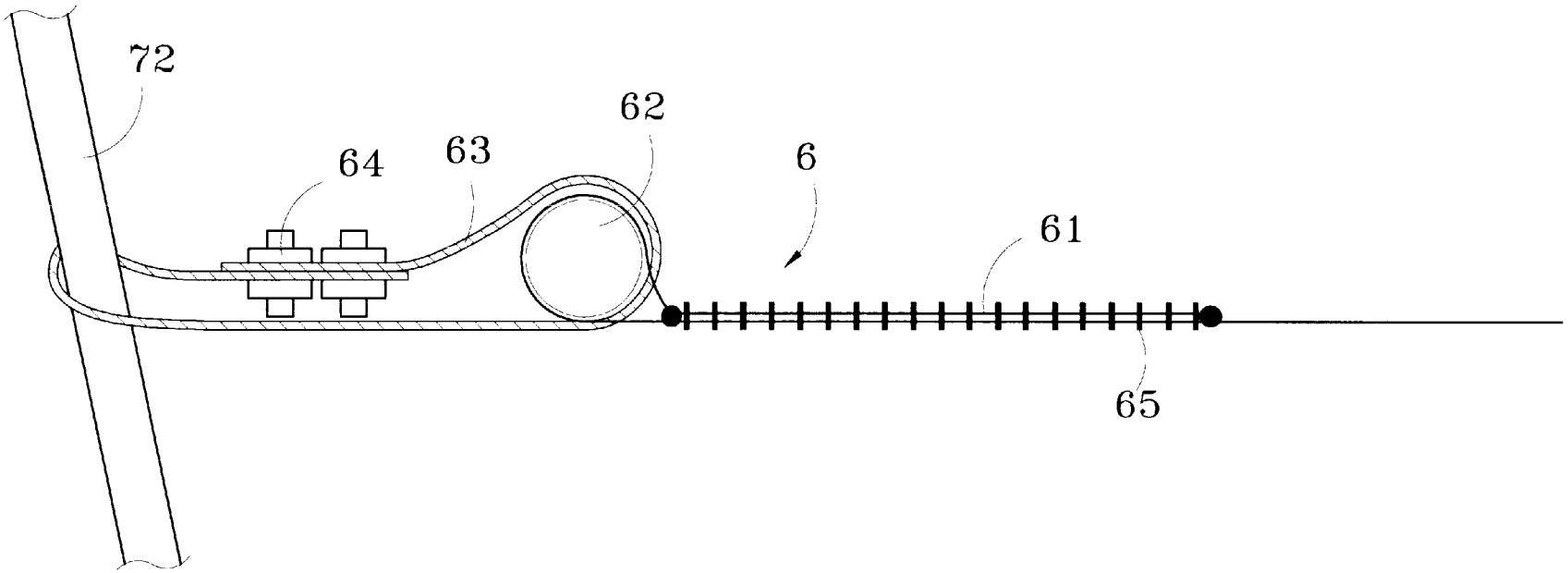
FIG. 7 is an enlarged view of FIG. 5B, for a single reinforced layer.
Figure 8:
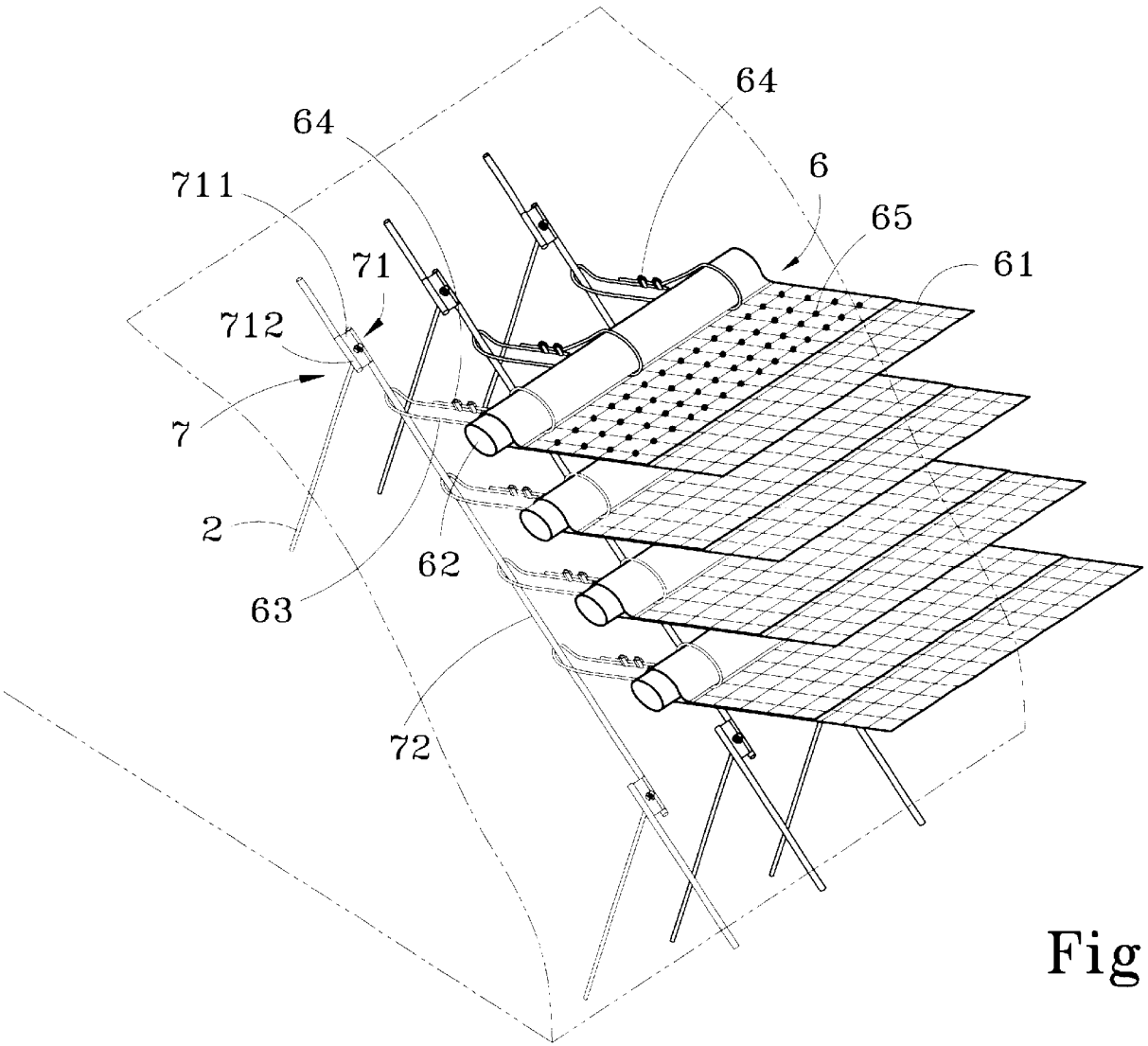
FIG. 8 is a schematic view of the invention with the reinforced materials (geogrid or grill meshes) fastened to soil nailing.

Referring to FIGS. 7 and 8, after the fastening means 7 is assembled on the soil nailing 2, install the reinforced retaining wall 6 on the fastening means 7.

The reinforced retaining wall 6 includes a reinforced grill mesh or geogrid 61, a support beam 62, a rope 63 and a clamp means 64. The reinforced grill mesh or geogrid 61 is to reinforce retaining earth (not shown in the drawings).

The support beam 62 may be made of stainless steel pipe and is wrapped by the reinforced grill mesh or geogrid 61. The reinforced grill mesh or geogrid 61 wraps around the support beam 62 and is overlapped and engaged with another reinforced grill mesh or geogrid 61 by clip devices 65.

The rope 63 may be made of a steel cable to wind around the support beam 62 and the strut 72 for anchoring the reinforced grill mesh or geogrid 61. The rope 63 may be slid on the strut 72 up or down without breaking away.

The clamp means 64 clamps and fastens two free ends of the rope 63 after winding around the support beam 62 and strut 72 so that the reinforced grill mesh or geogrid 61 will be harnessed by the strut 72 without slipping away.

During construction of one layer of the reinforced retaining wall 6, lay the reinforced grill mesh or geogrid 61 on the work site 1, then lay and pile up sacks of retaining earth (not shown in the drawings) on the reinforced grill mesh or geogrid 61 and compact to desired density. Then wind the reinforced grill mesh or geogrid 61 around the support beam 62 to couple with another layer of reinforced grill mesh or geogrid 61 through the clip devices 65. Then wind the rope 63 around the support beam 62 and strut 72, and clamp the rope 63 at the two free ends thereof by the clamp means 64 to complete the installation of the reinforced retaining wall 6.

As the rope 63 may be slid up or down on the strut 72 according geographical conditions, the fastening means may be free from stress concentration resulting from settlement of foundation or sagging of the reinforced materials.

Furthermore, the fastening means 7 can integrate the soil nailing 2 and reinforced retaining wall 6 to become one rigid body. Sliding at the interface between the two can be prevented from incurring. Construction thus can be done more rapidly to save time and work. Consumption of the soil nailing 2 can also be reduced, and the foundation width of the reinforced retaining wall 6 can also be decreased.

What is claimed is:

1. A fastening structure for soil nailing and reinforced retaining walls, comprising:

at least one soil nailing installed and buried in earth through a wall of a slope land work site;

at least one fastening means fixedly mounted to the soil nailing; and at least one reinforced retaining wall engaging with the fastening means;

wherein the soil nailing is installed in the earth through the wall at the work site, then the fastening means is mounted to the soil nailing and the reinforced retaining wall is fastened to the fastening means to complete the system, wherein the fastening means includes a coupling element and a strut, and wherein the coupling element has a flange engaging with an earth spike and an annular sleeve extending from one end of the flange.

2. The structure for fastening soil nails to reinforced soil retaining walls of claim 1, wherein the reinforced retaining wall includes a reinforced grill mesh or geogrid, a support beam, and a clamp means.

3. The structure for fastening soil nails to reinforced soil retaining walls of claim 2, wherein the support beam is made of a stainless steel pipe.

4. The structure for fastening soil nailing to reinforced soil retaining walls of claim 2, wherein the rope is made of a steel cable.

5. A fastening structure for soil nailing and reinforced retaining walls, comprising:

at least one soil nailing installed and buried in earth through a wall of a slope land work site;

at least one fastening means fixedly mounted to the soil nailing; and at least one reinforced retaining wall engaging with the fastening means;

wherein the soil nailing is installed in the earth through the wall at the work site, then the fastening means is mounted to the soil nailing and the reinforced retaining wall is fastened to the fastening means to complete the system, wherein the fastening means includes a coupling element and a strut, and wherein the strut is made of solid or hollow steel pipes and slidably coupling with a rope.

6. A fastening structure for soil nailing and reinforced retaining walls, comprising:

at least one soil nailing installed and buried in earth through a wall of a slope land work site;

at least one fastening means fixedly mounted to the soil nailing; and at least one reinforced retaining wall engaging with the fastening means;

wherein the soil nailing is installed in the earth through the wall at the work site, then the fastening means is mounted to the soil nailing and the reinforced retaining wall is fastened to the fastening means to complete the system, wherein the reinforced retaining wall includes a reinforced grill mesh or geogrid, a support beam, a rope and a clamp means, and wherein the clamp means fastens two free ends of the rope.

* * * * *